US010150929B2

(12) United States Patent
Suetsugu et al.

(10) Patent No.: US 10,150,929 B2
(45) Date of Patent: Dec. 11, 2018

(54) UREA GREASE

(71) Applicant: IDEMITSU KOSAN CO., LTD., Chiyoda-ku (JP)

(72) Inventors: Yoshiyuki Suetsugu, Sodegaura (JP); Kouji Takane, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/313,385

(22) PCT Filed: Mar. 31, 2015

(86) PCT No.: PCT/JP2015/060256
§ 371 (c)(1),
(2) Date: Nov. 22, 2016

(87) PCT Pub. No.: WO2015/182242
PCT Pub. Date: Dec. 3, 2015

(65) Prior Publication Data

US 2017/0253826 A1 Sep. 7, 2017

(30) Foreign Application Priority Data

May 27, 2014 (JP) ..... 2014-108851

(51) Int. Cl.
*C10M 115/08* (2006.01)
*C10M 177/00* (2006.01)

(52) U.S. Cl.
CPC ..... *C10M 115/08* (2013.01); *C10M 177/00* (2013.01); *C10M 2207/026* (2013.01);
(Continued)

(58) Field of Classification Search
CPC ..... C10M 115/08; C10M 177/00; C10M 2207/026; C10M 2215/06;
(Continued)

(56) References Cited

U.S. PATENT DOCUMENTS 6,037,314 A * 3/2000 Kondo ..... C10M 169/06 508/321
6,136,762 A 10/2000 Yoshinari et al.
(Continued)

FOREIGN PATENT DOCUMENTS

AU 3852372 A * 8/1973
JP 47-16503 9/1972
(Continued)

OTHER PUBLICATIONS

International Search Report dated Jun. 2, 2015, in PCT/JP2015/060256, filed Mar. 31, 2015.
(Continued)

*Primary Examiner* — James C Goloboy
(74) *Attorney, Agent, or Firm* — Oblon, McClelland, Maier & Neustadt, L.L.P.

(57) ABSTRACT

A urea grease of the invention is prepared by applying shear at a shear rate of $10^2$ $s^{-1}$ or more to a mixture solution of an amine mixture containing an alicyclic monoamine and a chain aliphatic monoamine, and a diisocyanate compound to cause a reaction in the mixture, in which the urea grease has Peak High32-64s of 1.5 or less and Level High32-64s of 10 or less according to an FAG method.

16 Claims, 8 Drawing Sheets

(52) U.S. Cl.
CPC . *C10M 2215/06* (2013.01); *C10M 2215/1026* (2013.01); *C10M 2223/041* (2013.01); *C10N 2230/76* (2013.01); *C10N 2240/02* (2013.01); *C10N 2250/10* (2013.01)

(58) Field of Classification Search
CPC .... C10M 2215/1026; C10M 2223/041; C10N 2230/76; C10N 2240/02; C10N 2250/10
See application file for complete search history.

(56) References Cited

U.S. PATENT DOCUMENTS

| | | | | |
|---|---|---|---|---|
| 2002/0039973 | A1* | 4/2002 | Baum | C10M 119/24 508/552 |
| 2007/0197413 | A1 | 8/2007 | Baum | |
| 2014/0080744 | A1* | 3/2014 | Fujinami | C10M 169/02 508/552 |

FOREIGN PATENT DOCUMENTS

| | | | |
|---|---|---|---|
| JP | 2-4895 | A | 1/1990 |
| JP | 3-190996 | A | 8/1991 |
| JP | 11-21580 | A | 1/1999 |
| JP | 2000-248290 | A | 9/2000 |
| JP | 2008-143979 | A | 6/2008 |
| WO | WO 2013/125510 | A1 | 8/2013 |

OTHER PUBLICATIONS

Extended European Search Report dated Nov. 22, 2017 in Patent Application No. 15800377.2.

* cited by examiner

UREA GREASE

TECHNICAL FIELD

The present invention relates to a urea grease.

BACKGROUND ART

Though having excellent heat resistance, urea grease is sometimes inferior in acoustic characteristics depending on amine(s) to be used. Accordingly, different greases have been typically used depending on the usage. However, in some applications (e.g. ball bearings installed in a small-sized motor for a household electrical appliance), both of the acoustic characteristics and heat resistance have been required to be satisfied.

In view of the above demand, a diurea grease containing a first amine component including an amine with a cyclohexyl group and a cyclohexyl derivative group having 7 to 12 carbon atoms, and a second amine with an alkyl group having 6 to 22 carbon atoms, the first amine and the second amine being used at a predetermined ratio, has been proposed (see Patent Literature 1).

CITATION LIST

Patent Literature(s)

Patent Literature 1: JP-A-2008-143979

SUMMARY OF THE INVENTION

Problems to be Solved by the Invention

The urea grease disclosed in Patent Literature 1 is made through a batch process and is excellent in appearance, heat resistance and acoustic characteristics. However, lumps can be found in the manufactured grease when the grease is checked using an optical electron microscope.

In view of the above, an object of the invention is to provide a fine urea grease that is capable of maintaining excellent heat resistance and acoustic characteristics and producing no lump visible using an optical electron microscope.

Means for Solving the Problems

In order to solve the above problem, the invention provides the following urea grease.

A urea grease according to an aspect of the invention is prepared by shearing a mixture solution of an amine mixture comprising an alicyclic monoamine and a chain aliphatic monoamine and a diisocyanate compound at a shear rate of $10^2$ $s^{-1}$ or more to cause a reaction, in which the urea grease has a Peak High32-64 s of 1.5 or less and a Level High32-64 s of 10 or less according to an FAG method.

According to the above aspect of the invention, as compared to typical urea greases, a finer urea grease that is capable of maintaining excellent heat resistance and acoustic characteristics and producing no lump visible using an optical electron microscope can be provided.

DESCRIPTION OF EMBODIMENT(S)

Figure 1:
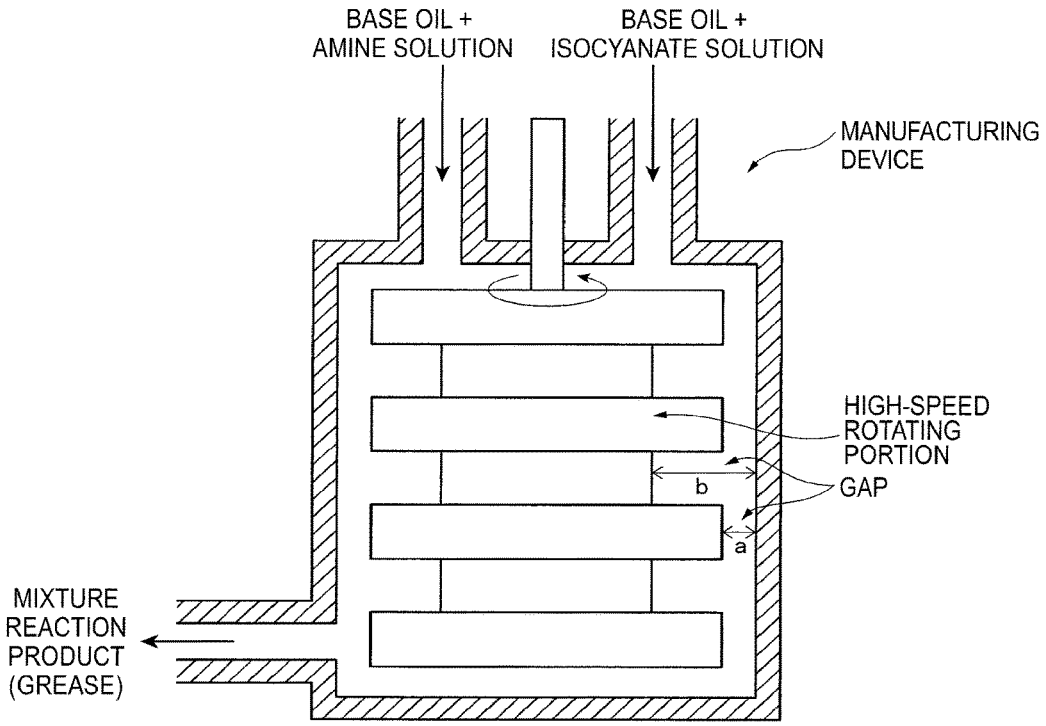
FIG. 1 is a schematic cross-sectional view showing an example of a manufacturing device of a urea grease in an exemplary embodiment of the invention.

A urea grease in an exemplary embodiment of the invention (hereinafter, also referred to as "the present grease") uses a thickener obtained by reacting an amine mixture including alicyclic monoamine and chain aliphatic monoamine compound, and a diisocyanate compound in a solution. The thickener is provided by applying a shear rate of $10^3$ $s^{-1}$ or more to the solution during the reaction. The urea grease has Peak High32-64 s of 1.5 or less and Level High32-64 s of 7 or less according to an FAG method. The exemplary embodiment of the invention will be described below in detail.

Constitution of Urea Grease

The base oil used in the present grease is not particularly limited, but may be any mineral base oil and synthetic base oil typically usable for manufacturing a typical grease. One of the mineral base oil and synthetic base oil may be used alone or a mixture thereof may be used.

Usable mineral oils are obtained by purification in an appropriate combination of vacuum distillation, solvent deasphalting, solvent extraction, hydrocracking, solvent dewaxing, sulfate cleaning, clay purification, hydrorefining and the like. Examples of the synthetic base oil include polyalphaolefin (PAO) base oil, other hydrocarbon base oil, ester base oil, alkyldiphenylether base oil, polyalkylene glycol base oil (PAG), and alkylbenzene base oil.

The thickener used in the present grease is obtained by a reaction in a mixture solution of the amine mixture including the alicyclic monoamine and chain aliphatic monoamine, and the diisocyanate compound. In order to enhance both of the acoustic characteristics and lubrication lifetime, it is necessary in the exemplary embodiment that a shear rate of $10^3$ $s^{-1}$ or more is applied to the above mixture solution in the reaction.

Examples of the above-described alicyclic monoamine include cyclohexylamine and alkylcyclohexylamine. One of the alicyclic monoamines may be used alone or a plurality of the alicyclic monoamines may be mixed in use. Among the above, cyclohexylamine is preferable in terms of heat resistance.

Examples of the above-described chain aliphatic monoamine include hexyl amine, octyl amine, dodecyl amine, hexadecyl amine, stearyl amine and eicosyl amine. One of the chain aliphatic monoamines may be used alone or a plurality of the chain aliphatic monoamines may be mixed in use. Among the above, stearyl amine is preferable in terms of acoustic characteristics.

A molar ratio of the alicyclic monoamine to the chain aliphatic monoamine is preferably in a range from 5:1 to 1:4, more preferably in a range from 4:1 to 2:3, especially preferably in a range from 4:1 to 2:1 in order to enhance both of the acoustic characteristics and lubrication lifetime.

Examples of the diisocyanate compound include diphenylmethane-4,4'-diisocyanate (MDI), tolylene diisocyanate, and naphthylene-1,5-diisocyanate. One of the diisocyanates may be used alone or a plurality of diisocyanates may be mixed in use.

The present grease is required to have Peak High32-64 s of 1.5 or less and Level High32-64 s of 10 or less according to the FAG method.

A required level of each of the Peak High32-64 s and the Level High32-64 s depends on usage. However, the Peak High32-64 s exceeding 1.5 is insufficient since the acoustic characteristics are in the same level as those of a conventional art. The Peak High32-64 s is preferably 0.7 or less.

Moreover, the Level High32-64 s exceeding 10 is insufficient since the acoustic characteristics are in the same level as those of a conventional art. The Level High32-64 s is preferably 7 or less.

Herein, the Peak High32-64 s and Level High32-64 s according to the FAG method can be measured using an acoustic measurement device dedicated for a grease ("Grease Test Rig Be Quiet-h" manufactured by SKF). Specifically, a bearing dedicated for an acoustic measurement, in which a grease is not filled, is set in the acoustic measurement device. While the bearing is being rotated at a predetermined speed, acoustic data is obtained after the elapse from 32 seconds to 64 seconds since the bearing starts rotating. The above operations are repeated for six times in total without exchanging the bearing. Specifically, a predetermined amount of sample (grease) is filled in the bearing, and, while the bearing is being rotated at a predetermined speed, acoustic data is obtained after the elapse from 32 seconds to 64 seconds since the bearing starts rotating. The above operations are repeated for six times in total without exchanging the bearing. The acoustic data is analyzed using a program installed in the acoustic measurement device to obtain an average of the six measurements of the Peak High and Level High.

The same operations (six operations without filling the grease and six operations after filling the grease) are performed on another dedicated bearing and the results are similarly analyzed using the program to obtain an average. The averages measured for the two bearings are averaged to obtain the values of the Peak High and the Level High according to the FAG method.

Usually, after a grease is filled in a bearing, the acoustic characteristics are evaluated based on acoustic data after the elapse from 32 seconds to 64 seconds from the start of the first rotation in the FAG method. An acoustic peak is sometimes observed due to rupture of air bubbles supposed to be contained in the grease after the elapse from 32 seconds to 64 seconds from the start of the first rotation. However, the evaluation on the acoustic characteristics is unduly downgraded when the acoustic peak supposed to be derived from the rupture of air bubbles is observed in a grease that has inherently excellent acoustic characteristics. Highly reproducible results of the acoustic characteristics often cannot be obtained even after 3 to 5 repetitions of the measurements. Accordingly, in order to overcome the above deficiencies, six measurements are performed for one dedicated bearing in the exemplary embodiment. The peak supposed to be derived from the rupture of air bubbles decreases after the second rotation and thus highly reproducible data can be obtained with the use of the average of the six measurements.

A method for providing the Peak High32-64 s and Level High32-64 s obtainable by the FAG method in the above-described range is exemplified by a later-described manufacturing method of the present grease under a uniform high shear.

Various additives may be further added to the present grease. Examples of the additives include an antioxidant, extreme pressure agent, and rust inhibitor.

Examples of the antioxidant include: an amine antioxidant such as alkylated diphenylamine, phenyl-α-naphthylamine and alkylated-α-naphthylamine; and a phenol antioxidant such as 2,6-di-t-butyl-4-methylphenol and 4,4-methylenebis (2,6-di-t-butylphenol). A content of the antioxidant is preferably in a range from approximately 0.05 mass % to 5 mass % based on a total amount of the grease.

Examples of the extreme pressure agent include thiocarbamates such as zinc dialkyldithiophosphate, molybdenum dialkyldithiophosphate, ashless dithiocarbamate, zinc dithiocarbamate and molybdenum dithiocarbamate, sulfur compound (e.g. sulfurized fat and oil, sulfurized olefin, polysulfide, sulfurized mineral oil, thiophosphates, thioterpenes and dialkylthiodipropionates), phosphates and phosphites (e.g. tricresyl phosphate and triphenyl phosphite). A content of the extreme pressure agent is preferably in a range from approximately 0.1 mass % to 5 mass % based on the total amount of the grease.

Examples of the rust inhibitor include benzotriazole, zinc stearate, succinate, succinic acid derivative, thiadiazole, benzotriazole, benzotriazole derivative, sodium nitrite, petroleum sulphonate, sorbitan monooleate, fatty acid soap and amine compound. A content of the rust inhibitor is preferably in a range from approximately 0.01 mass % to 10 mass % based on the total amount of the grease.

One of the above various additives may be blended alone, or alternatively, a plurality of those may be blended in combination.

Manufacturing Method of Urea Grease

The present grease can be manufactured, for instance, by a later-described manufacturing method of the present grease (hereinafter, also referred to as "the present manufacturing method"). In the present manufacturing method, a first base oil containing the amine mixture and a second base oil containing the diisocyanate compound are mixed to prepare a mixture solution and a shear rate of $10^3$ $s^{-1}$ or more is applied to the mixture solution. In other words, within a short time after the first base oil and the second base oil are mixed, high shear is applied to the mixture solution. Subsequently, the amine mixture and the diisocyanate compound are mixed and dispersed to react with each other, thereby preparing a thickener. The present manufacturing method will be described below in detail.

Base Oil

The first base oil and the second base oil usable in the present manufacturing method are not particularly limited, but may be any base oils usable in the present grease.

A kinematic viscosity at 40 degrees C. of each of the first base oil and the second base oil is preferably in a range from 10 $mm^2/s$ to 600 $mm^2/s$.

Considering compatibility of the first base oil and the second base oil, the first base oil and the second base oil preferably have similar polar characteristics and similar viscosity characteristics. Accordingly, the first base oil and the second base oil are most preferably the same base oil in use.

Thickener

In the present manufacturing method, the thickener is formed from the amine mixture and the diisocyanate compound.

As the amine mixture and the diisocyanate compound, the examples of those usable in the present grease are usable.

The diisocyanate compound and the amine mixture are continuously introduced at a molar ratio of 1:2 into a reactor (a grease manufacturing device) and are immediately subjected to a high shear as described later to be mixed and reacted with each other, so that a diurea grease having less large lumps can be manufactured. Moreover, the above-described mixture of the diisocyanate compound and the monoamine compound is continuously introduced at equivalent amounts of an isocyanate group and an amino group into a reactor (a grease manufacturing device) and are similarly subjected to a high shear to be mixed and reacted with each other, so that a urea grease having less large lumps can be manufactured.

Manufacturing Method of Grease

In the present manufacturing method, the first base oil containing the amine mixture and the second base oil containing the diisocyanate compound are mixed to prepare the mixture solution and a minimum shear rate of $10^2$ $s^{-1}$ or more is applied to the mixture. In other words, in order to inhibit formation or growth of the lumps, it is crucial to apply a high shear to the mixture solution within the shortest time as possible after the first base oil and the second base oil are put into the reactor.

Specifically, a time elapsed before applying the above shear rate after putting the first base oil and the second base oil in the reactor is preferably within 15 minutes, more preferably within 5 minutes, further preferably within 10 seconds. Since a reaction starts after the diisocyanate compound and the amine mixture are well mixed and dispersed, when the elapsed time is shorter, molecules of the thickener are less likely to form a thick bundle and a large lump.

The minimum shear rate applied to the above mixture solution is $10^2$ $s^{-1}$ or more as described above, preferably $10^3$ $s^{-1}$ or more, more preferably $10^4$ $s^{-1}$ or more. A higher shear rate provides a more improved dispersion condition of the diisocyanate compound and the monoamine compound and the formed thickener, thereby providing a more uniform grease structure. In other words, the molecules of the thickener do not form a thick bundle and a large lump.

Considering safety of the device and heat generated by shear and the like and removal of the heat, the minimum shear rate applied to the above mixture solution is preferably $10^7$ $s^{-1}$ or less.

The above shear rate can be applied to the mixture solution, for instance, by introducing the mixture into a reactor configured to cause shear by relative movement of facing wall surfaces.

Figure 2:
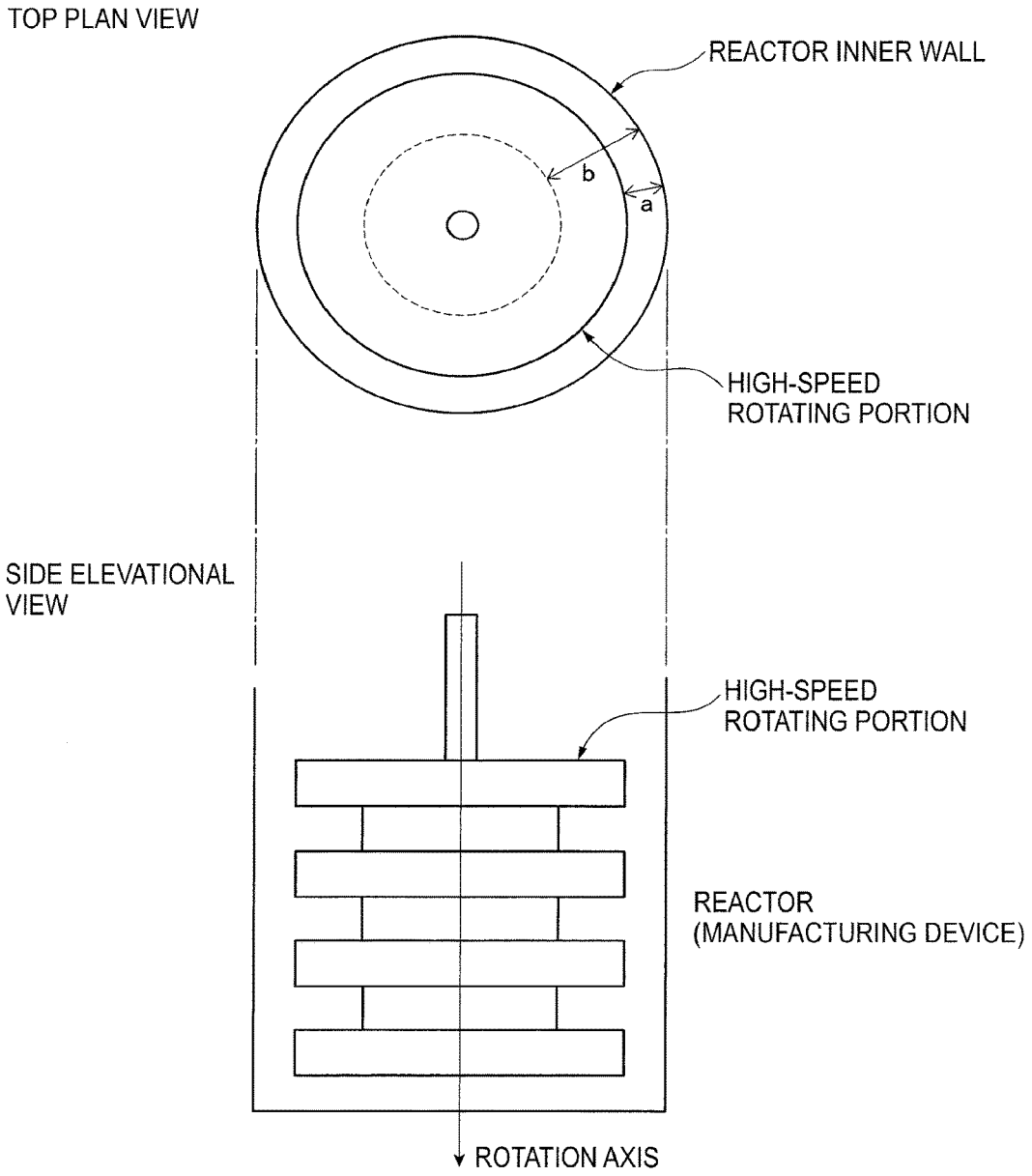
FIG. 2 schematically shows a lateral side and a top side of the manufacturing device in FIG. 1.

A grease manufacturing device (the reactor) capable of generating such a high shear rate is exemplified by a manufacturing device structured as shown in FIG. 1. FIG. 2 schematically shows a lateral side and a top side of the manufacturing device in FIG. 1.

The manufacturing device shown in FIG. 1 is configured to mix two types of base oils and uniformly apply high shear to the obtained mixture within an extremely short time. The high shear is applied to the mixture solution by a gap (a, b) between a high-speed rotating portion and an inner wall of the reactor. A diameter of the high-speed rotating portion may be constant (a=b) in a direction of a rotation axis, or alternatively, the gap may be different. The gap may be adjusted by changing the diameter of the high-speed rotating portion in the direction of the rotation axis, or alternatively, by providing the high-speed rotating portion in a form of a truncated cone and vertically moving the high-speed rotating portion with respect to an inner wall of a tapered reactor.

Further, the portions having a large gap may be provided by a screw or a spiral having continuous inclination, whereby extrusion capability may be provided to the high-speed rotating portion.

Figure 3:
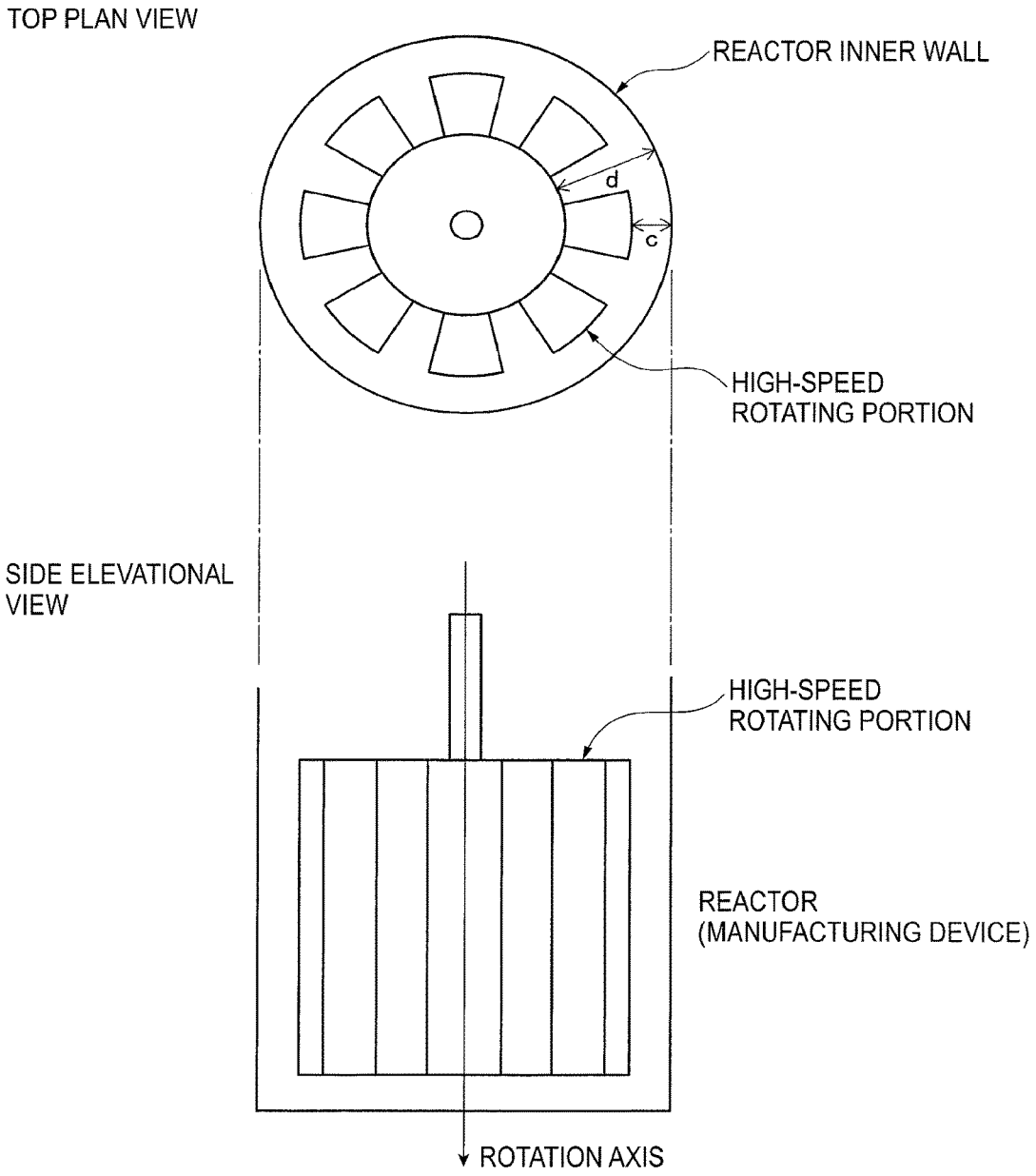
FIG. 3 schematically shows a lateral side and a top side of a manufacturing device of a urea grease in another exemplary embodiment of the invention.
Figure 4:
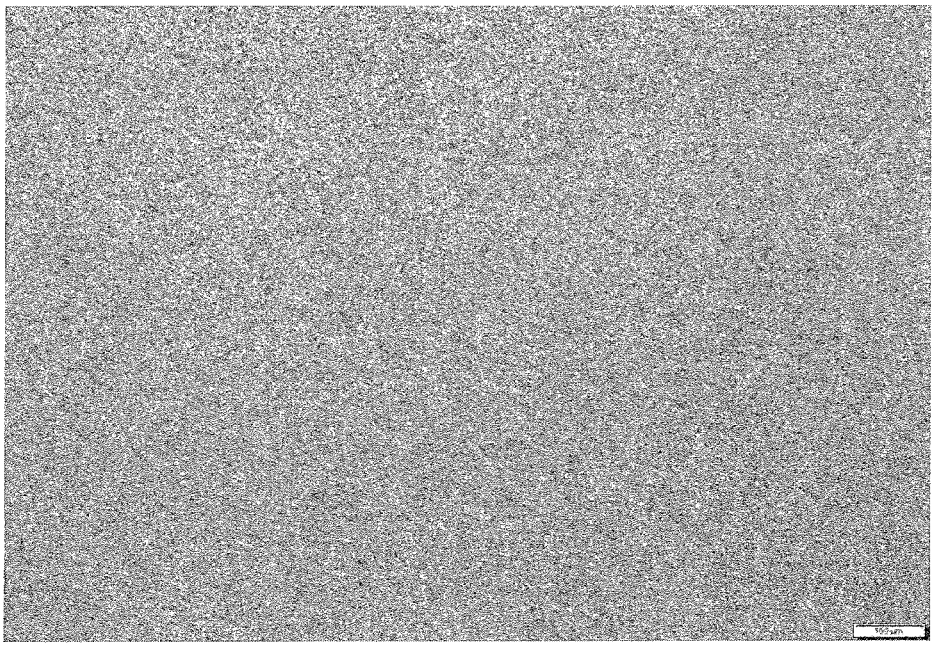
FIG. 4 is an optical micrograph of a urea grease manufactured in Example 1 of the invention.
Figure 5:
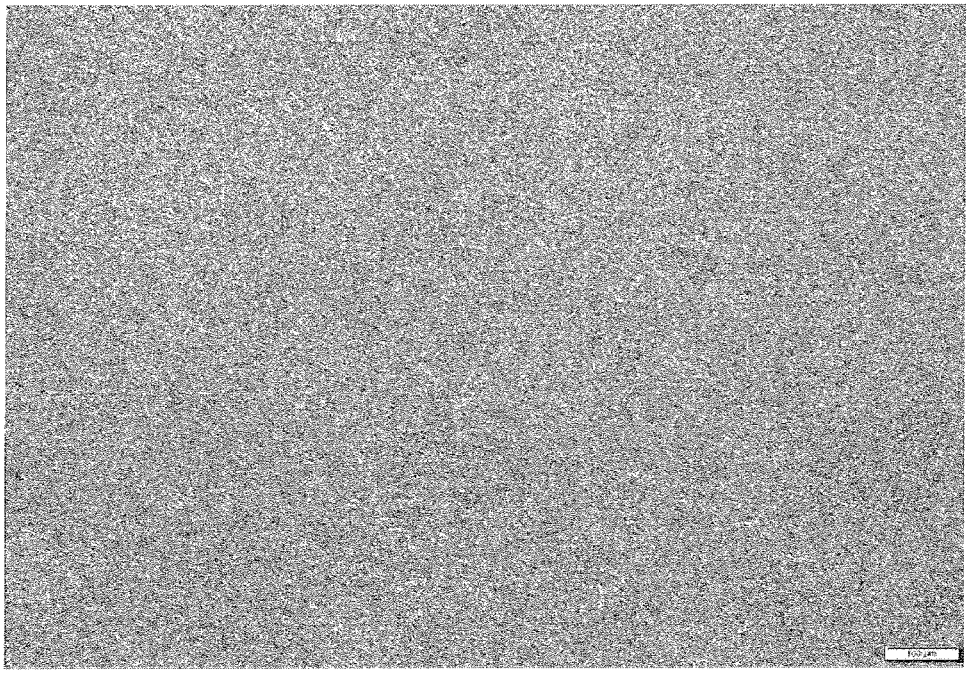
FIG. 5 is an optical micrograph of a urea grease manufactured in Example 2 of the invention.
Figure 6:
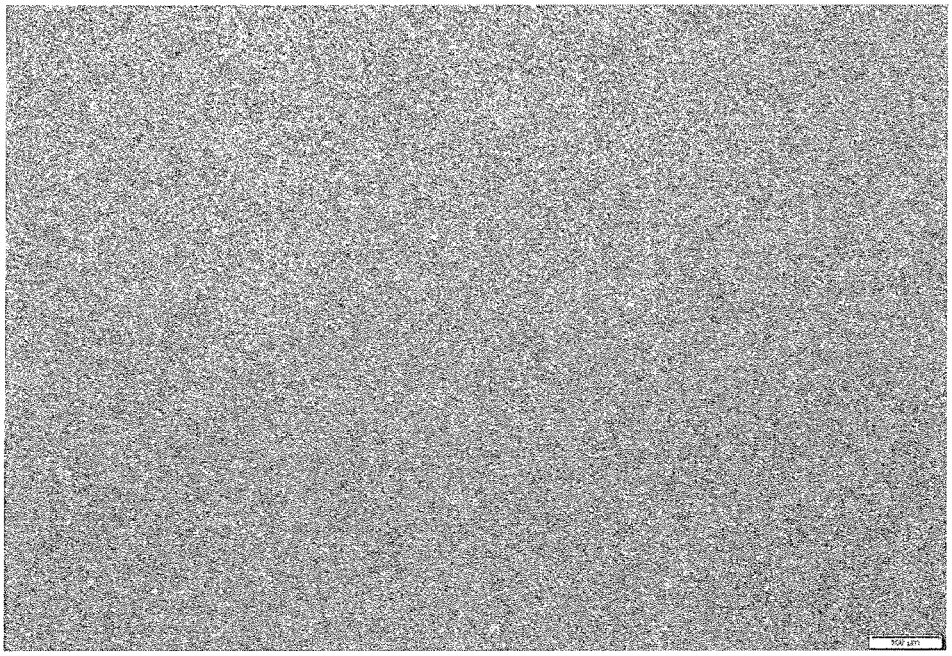
FIG. 6 is an optical micrograph of a urea grease manufactured in Example 3 of the invention.
Figure 7:
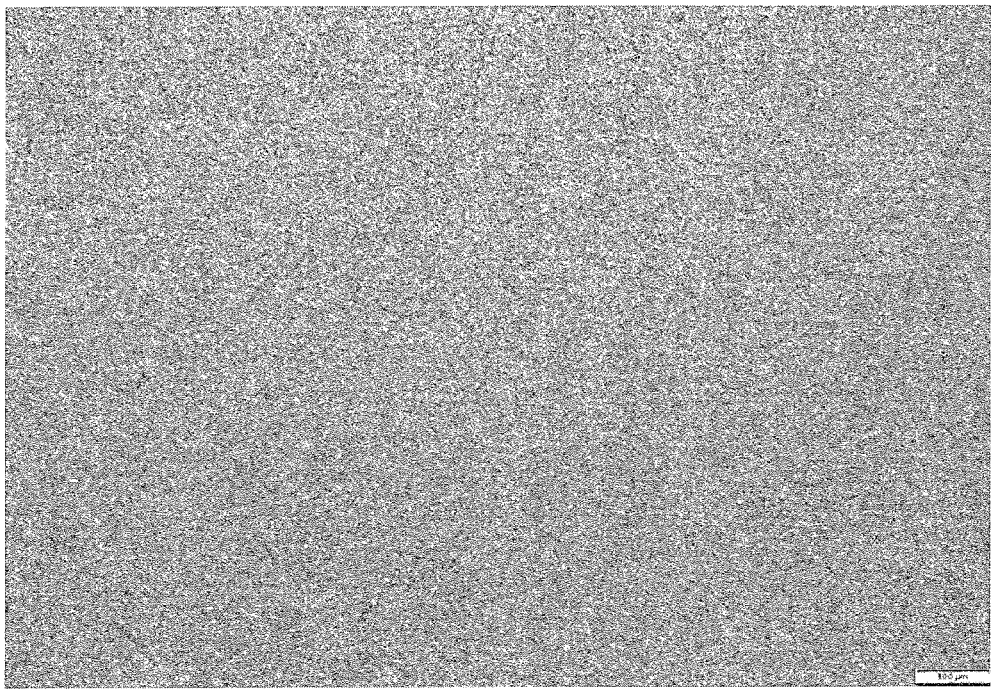
FIG. 7 is an optical micrograph of a urea grease manufactured in Example 4 of the invention.
Figure 8:
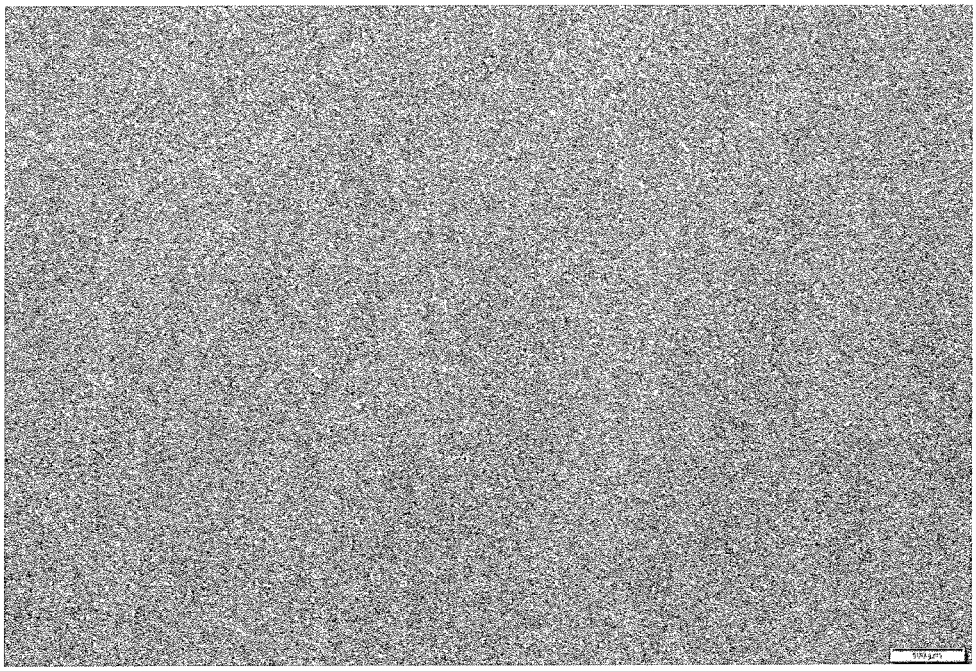
FIG. 8 is an optical micrograph of a urea grease manufactured in Comparative 1 of the invention.

FIG. 3 shows a reactor (a manufacturing device of a grease) having a structure different from that of the reactor in FIG. 1, the portions having different gaps are disposed in a rotation direction. In this manufacturing device, the portions having a large gap may be inclined relative to a rotation axis, whereby extrusion capability as provided by a screw may be provided to the high-speed rotating portion.

In the above reactor, a ratio (Max/Min) of a maximum shear rate (Max) to a minimum shear rate (Min) in the shear applied to the mixture solution is preferably 100 or less, more preferably 70 or less, further preferably 50 or less, particularly preferably 10 or less. When the shear rate applied to the mixture solution is as uniform as possible, a grease having a uniform structure without having grown lumps is provided.

Herein, the maximum shear rate (Max) refers to a maximum shear rate applied to the mixture solution and the minimum shear rate (Min) refers to a minimum shear rate applied to the mixture solution. The maximum shear rate (Max) and the minimum shear rate (Min) are defined as follows, for instance, in the reactor shown in FIG. 1.

Max=(a linear velocity of a surface of the high-speed rotating portion at the minimum gap between the surface of the high-speed rotating portion and an inner wall surface of the reactor/the gap)

Min=(a linear velocity of a surface of the high-speed rotating portion at the maximum gap between the surface of the high-speed rotating portion and the inner wall surface of the reactor/the gap)

In FIG. 1, the gap used for calculating Max is a and the gap used for calculating Min is b.

Since a smaller Max/Min is preferable as described above, ideally a=b. In other words, in case of the reactor as shown in FIG. 1, the high-speed rotating portion is most preferably a cylinder vertically having a uniform diameter.

When the manufacturing device manufactures a urea grease, the manufacturing device may have a structure as shown in FIG. 3.

The present manufacturing method is applicable to all grease manufacturing methods including mixing a solution of the first base oil and the amine mixture with a solution of the second base oil and the diisocyanate compound. Although a temperature condition for manufacturing the thickener differs depending on the precursors to be used, the temperature in a range from approximately 50 degrees C. to 200 degrees C. is preferable when manufacturing urea as the thickener. When the temperature is equal to or more than 50 degrees C., isocyanate is likely to be dissolved in the base oil. When the temperature is equal to or less than 200 degrees C., deterioration of the base oil can be sufficiently inhibited. A temperature of a solution of the base oil and amine before being introduced into the reactor is preferably in a range from approximately 50 degrees C. to 100 degrees C.

In the present manufacturing method, the grease obtained by the above manufacturing method may be further kneaded. For this kneading, a roll mill generally used for manufacturing a grease is usable. The above grease may be subjected to the roll mill twice or more.

In the present manufacturing method, the grease obtained by the above manufacturing method may be further heated to the temperature in a range from 70 degrees C. to 250 degrees C. When the heating temperature exceeds 250 degrees C., the grease may be deteriorated. A heating time at this time is preferably in a range from thirty minutes to two hours. Further, for uniform heating, the grease may be kneaded and stirred. A furnace or the like may be used for heating.

EXAMPLES

The invention will be described in further detail with reference to Examples and Comparatives, but the description is mere illustrative and not exhaustive of the invention. Specifically, a urea grease was manufactured under the following various conditions and properties of the obtained grease were evaluated.

Example 1

A grease was manufactured using a urea grease manufacturing device as shown in FIG. 3. A grease manufacturing method was specifically performed as follows.

A PAO base oil (poly-α-olefin (a kinematic viscosity at 40 degrees C. of 63 $mm^2/s$, a kinematic viscosity at 100 degrees C. of 9.8 $mm^2/s$) containing cyclohexylamine of 3.4 mass % and stearyl amine 13.7 mass %) heated at 70 degrees C. and a PAO base oil (poly-α-olefin (a kinematic viscosity at 40 degrees C. of 63 $mm^2/s$, a kinematic viscosity at 100 degrees C. of 9.8 $mm^2/s$) containing MDI of 6.0 mass %) also heated at 70 degrees C. were continuously introduced at respective flow rates of 508 mL/min and 890 mL/min into a manufacturing device. Immediately after the introduction, a maximum shear rate of 216,000 $s^{-1}$ was applied to the obtained mixture solution by a high-speed rotating portion when the mixture passed a gap. A ratio (Max/Min) of the maximum shear rate (Max) to the minimum shear rate (Min) when the mixture passed the gap was 5.4. A time elapsed before applying the maximum shear rate to the mixture solution after mixing the above two base oils was about three seconds. An amount of the thickener in the manufactured grease was 10 mass % based on the total amount of the grease. The obtained grease was heated for an hour at 160 degrees C. while stirring, and was subjected to two roll mill processes after being cooled. As the roll mill, a three-roll mill, model 50 (roll diameter=50 mm) manufactured by EXAKT Technologies, Inc., was used.

The obtained grease was evaluated according to the standards mentioned below and a lump formation state of the obtained grease was observed with an optical microscope. The same applies to later-described greases in Examples and Comparatives.

Example 2

Grease was manufactured in the same manner as in Example 1 except that the flow rate of the amine solution was changed to 178 mL/min, and the flow rate of the MDI solution was changed to 331 mL/min.

Example 3

Grease was manufactured in the same manner as in Example 1 except that the flow rate of the amine solution was changed to 253 mL/min, and the flow rate of the MDI solution was changed to 444 mL/min.

Example 4

Grease was manufactured in the same manner as in Example 1 except that the flow rate of the amine solution was changed to 573 mL/min, and the flow rate of the MDI solution was changed to 1000 mL/min.

Comparative 1

A urea grease was manufactured by a typical method. Specifically, a PAO base oil (poly-α-olefin (a kinematic viscosity at 40 degrees C. of 63 $mm^2/s$, a kinematic viscosity at 100 degrees C. of 9.8 $mm^2/s$) containing cyclohexylamine of 2.6 mass % and stearyl amine 10.5 mass %) kept at 60 degrees C. was dropped into a PAO base oil (poly-α-olefin (a kinematic viscosity at 40 degrees C. of 63 $mm^2/s$, a kinematic viscosity at 100 degrees C. of 9.8 $mm^2/s$) containing MDI of 7.25 mass %) kept at 60 degrees C. while being stirred by an impeller. After the amine solution was dropped therein, the mixture was heated to 160 degrees C. and maintained for an hour while being kept stirred. Subsequently, the mixture was left to be cooled while being stirred and was subjected to two roll mill processes. An amount of the thickener in the manufactured grease was 10 mass % based on the total amount of the grease. The maximum shear rate during the manufacturing of each of the greases was about 100 $s^{-1}$.

Evaluation of Grease

The grease was evaluated by the following method in terms of worked penetration, Peak High32-64 s, Level High32-64 s, fineness of the lumps, and centrifugal oil separation degree. The obtained results are shown in Table 1. The molar ratio (Cy:C18) of the cyclohexylamine (Cy) and stearyl amine (C18) in the amine mixture in each of the greases as well as the maximum shear rate, the minimum shear rate, the ratio (Max/Min) of the maximum shear rate (Max) to the minimum shear rate (Min) and the flow rate of the solution during manufacturing of each of the greases are also shown in Table 1. Further, FIGS. 4 to 8 show optical micrographs of the greases.

(1) Worked Penetration

A worked penetration was measured by a method in accordance with the description of JIS K2220.

(2) Peak High32-64 s and Level High32-64 s

Peak High32-64 s and Level High32-64 s are measurable using a grease-dedicated acoustic measurement device (Grease Test Rig Be Quiet+) manufactured by SKF. Specifically, a bearing dedicated for an acoustic measurement, in which a grease is not put, is set in the acoustic measurement device. While the bearing is being rotated at a predetermined speed, acoustic data is obtained after the elapse from 32 seconds to 64 seconds since the bearing starts rotating. The above operations are repeated for six times in total without exchanging the bearing. Additionally, a predetermined amount of sample (grease) is sealed in the bearing, and, while the bearing is being rotated at a predetermined speed, acoustic data is obtained after the elapse from 32 seconds to 64 seconds since the bearing starts rotating. The above operations are repeated for six times in total without exchanging the bearing. The acoustic data is analyzed using a program installed in the acoustic measurement device to obtain the values of the Peak High and Level High.

The same operations (six operations without filling the grease and six operations after filling the grease) are performed on another dedicated bearing and the results are similarly analyzed using the program to obtain values of the Peak High and Level High.

Each of the two sets of the values of the Peak High and Level High for the two bearings is averaged to obtain an average thereof.

(3) Fineness of Lump

An extremely small amount of the grease was laid on a glass slide, covered with Saran Wrap (registered trademark) (thickness: 11 μm) as a spacer, covered with a cover glass, and further covered with another glass slide. A vertical load of about 20 N was evenly applied on the thus covered mixture to crush the grease into a film. The upper glass slide was removed and the grease in a form of film was observed through a transmitted light brightfield method (without polarization) using an optical microscope (Olympus BX51) with a camera (Olympus DP73) being attached thereon. The objective lens used was Olympus MPLFLN10XBD (numerical aperture (NA) of 0.30). Small lumps of approximately 15 μm or less were often difficult to be observed, and thus a focal depth was increased to facilitate the observation. In the exemplary embodiment, capacitor scale of the optical microscope was set at 0.1 to narrow a diaphragm opening and the numerical aperture of the objective lens was reduced to one third to enlarge the focal depth. Clear images of the lumps were obtained through the above process. In order to avoid intentional selection of areas with small or large number of lumps, three photographs of each of the greases were randomly taken at a total magnification of 5×. The fineness of the lumps was visually checked using one of the three photographs other than the ones of the three photographs with the largest and smallest number of lumps. A scale is shown in the photograph.

The optical micrograph of each of the greases was visually checked and the fineness of the lumps was evaluated according to the following standards.

Pass: little or no lump(s) was observed in the optical micrograph.

Failure: lump was observed in the optical micrograph.

(4) Centrifugal Oil Separation Degree

A sample of 20 g of grease was put into a centrifugal separation tube of a centrifugal separator and a centrifugal oil separation degree when 16,000 G of acceleration was applied to the sample for three hours at 20 degrees C. was calculated according to the following formula.

Centrifugal oil separation degree (wt %)=(weight of separated oil/weight of loaded grease)×100

It has been confirmed from the results shown in Table 1 that all of the urea greases (Examples 1 to 4) of the invention exhibit excellent acoustic characteristics and have fineness enough for the lumps not to be observed.

In contrast, the urea grease manufactured in Comparative 1 by a typical method exhibits insufficient acoustic characteristics and the lumps are observed through the observation using an optical microscope, which proves inferior smoothness and fineness.

Example 5

A grease was manufactured using a urea grease manufacturing device as shown in FIG. 1. A grease manufacturing method was specifically performed as follows.

A 500N mineral oil (having a kinematic viscosity at 40 degrees C. of 90 $mm^2/s$ and containing MDI of 11.0 mass %) heated at 70 degrees C. and a 500N mineral oil (having a kinematic viscosity at 40 degrees C. of 90 $mm^2/s$ and containing octyl amine of 11.1 mass % and cyclohexylamine of 2.13 mass %) heated at 70 degrees C. were continuously introduced at respective flow rates of 258 mL/min and 214 mL/min into a manufacturing device. Immediately after the introduction, a maximum shear rate of 10,500 $s^{-1}$ was applied to the obtained mixture solution by a high-speed rotating portion when the mixture solution passed a gap. The minimum shear rate (Min) when the mixture passed the gap was 10,200 $s^{-1}$. The ratio (Max/Min) of the maximum shear rate (Max) to the minimum shear rate (Min) when the mixture passed the gap was 1.03. A time elapsed before applying the maximum shear rate to the mixture solution after mixing the above two base oils was about three seconds. The grease discharged from the manufacturing device was put into a container preheated at 60 degrees C. While being stirred at 250 rpm, the grease was immediately heated up to 120 degrees C., maintained for 30 minutes and further heated up to 160 degrees C. to be maintained for an hour. Subsequently, the grease was left to be cooled while being kept stirred, and subjected to a roll mill twice to obtain a grease. An amount of the thickener in the obtained grease was 12 mass % based on the total amount of the grease.

Example 6

A grease was obtained in the same manner as in Example 5 except that a PAO base oil (having a kinematic viscosity at 40 degrees C. of 63 $mm^2/s$ and containing MDI of 6.09 mass %) heated at 70 degrees C. and a PAO base oil (having a kinematic viscosity at 40 degrees C. of 63 $mm^2/s$ and containing cyclohexylamine of 7.03 mass % and stearyl amine of 4.78 mass %) also heated at 70 degrees C. were continuously introduced at respective flow rates of 880

TABLE 1

| | Molar Ratio in Amine Mixture (Cy:C18) | Maximum Shear Rate ($s^{-1}$) | Minimum Shear Rate ($s^{-1}$) | Ratio of Maximum Shear Rate to Minimum Shear Rate (Max/Min) (—) | Flow Rate of Solution (mL/min) | Worked Penetration | Centrifugal Oil Separation Degree (mass %) | Peak High 32-64 s | Level High 32-64 s | Fineness of Lump |
|---|---|---|---|---|---|---|---|---|---|---|
| Example 1 | 4:6 | 216,000 | 40,000 | 5.4 | 1398 | 217 | 0.7 | 0.41 | 6.61 | Pass |
| Example 2 | 4:6 | 10,500 | 5,000 | 2.1 | 509 | 221 | 0.6 | 0.40 | 6.22 | Pass |
| Example 3 | 4:6 | 10,500 | 5,000 | 2.1 | 697 | 219 | 0.3 | 0.54 | 6.36 | Pass |
| Example 4 | 4:6 | 10,500 | 5,000 | 2.1 | 1573 | 221 | 0.5 | 0.46 | 6.21 | Pass |
| Comparative 1 | 4:6 | Approx. 100 | 1.23 | 81 | — | 238 | 1.5 | 1.98 | 10.40 | Failure |

mL/min and 474 mL/min into a manufacturing device. An amount of the thickener in the obtained grease was 8 mass % based on the total amount of the grease.

The maximum shear rate (Max) when the mixture passed the gap was 10,500 $s^{-1}$ and minimum shear rate (Min) when the mixture passed the gap was 10,200 $s^{-1}$. The ratio (Max/Min) of the maximum shear rate (Max) to the minimum shear rate (Min) when the mixture passed the gap was 1.03.

Evaluation of Grease

The grease was evaluated by the above method in terms of a worked penetration, centrifugal oil separation degree, Peak High32-64 s, and Level High32-64 s. The obtained results are shown in Table 2. The amine composition and amount of the thickener in the amine mixture in each of the greases as well as the maximum shear rate, the minimum shear rate, and the ratio (Max/Min) of the maximum shear rate (Max) to the minimum shear rate (Min) during manufacturing of each of the greases are also shown in Table 2.

TABLE 2

| | Molar Ratio in Amine Mixture (Cy:C18) | Maximum Shear Rate ($s^{-1}$) | Minimum Shear Rate ($s^{-1}$) | Ratio of Maximum Shear Rate to Minimum Shear Rate (Max/Min) (—) | Worked Penetration | Centrifugal Oil Separation Degree (mass %) | Peak High 32-64 s | Level High 32-64 s |
|---|---|---|---|---|---|---|---|---|
| Example 5 | Cy:C18 = 1:4 | 10,500 | 10,200 | 1.03 | 264 | 4.3 | 0.81 | 8.05 |
| Example 6 | Cy:C18 = 4:1 | 10,500 | 10,200 | 1.03 | 233 | 1.6 | 0.58 | 6.22 |

According to the results shown in Table 2, a urea grease having excellent acoustic characteristics was obtained in Examples 5 and 6.

Example 7

A grease was obtained in the same manner as in Example 5 except that a 500N mineral oil (having a kinematic viscosity at 40 degrees C. of 90 $mm^2/s$ and containing MDI of 5.87 mass %) heated at 70 degrees C. and a 500N mineral oil (having a kinematic viscosity at 40 degrees C. of 90 $mm^2/s$ and containing cyclohexylamine of 3.35 mass % and stearyl amine of 13.7 mass %) also heated at 70 degrees C. were continuously introduced at respective flow rates of 300 mL/min and 180 mL/min into a manufacturing device. An amount of the thickener in the obtained grease was 10 mass % based on the total amount of the grease.

The maximum shear rate (Max) when the mixture passed the gap was 21,000 $s^{-1}$ and minimum shear rate (Min) when the mixture passed the gap was 20,400 $s^{-1}$. The ratio (Max/Min) of the maximum shear rate (Max) to the minimum shear rate (Min) when the mixture passed the gap was 1.03.

Comparative 2

A urea grease was manufactured by a typical method. Specifically, a 500N base oil (a kinematic viscosity at 40 degrees C. of 90 $mm^2/s$ containing cyclohexyl amine of 2.59 mass % and stearyl amine 10.54 mass %) kept at 60 degrees C. was dropped into a 500N mineral oil (a kinematic viscosity at 40 degrees C. of 90 $mm^2/s$ containing MDI of 7.25 mass %) kept at 60 degrees C. while being stirred by an impeller. After the amine solution was dropped therein, the mixture was heated to 160 degrees C. and maintained for an hour while being kept stirred. Subsequently, the grease was left to be cooled while being kept stirred, and subjected to a roll mill twice to obtain a grease. An amount of the thickener in the obtained grease was 12 mass % based on the total amount of the grease.

The maximum shear rate (Max) and minimum shear rate (Min) during manufacturing of each of the greases were respectively 100 $s^{-1}$ and 1.23 $s^{1}$. The ratio (Max/Min) of the maximum shear rate (Max) to the minimum shear rate (Min) when the mixture passed the gap was 81.

Example 8

A grease was obtained in the same manner as in Example 5 except that an ester synthetic oil (having a kinematic viscosity at 40 degrees C. of 33 $mm^2/s$ and containing MDI of 5.87 mass %) heated at 70 degrees C. and an ester synthetic oil (having a kinematic viscosity at 40 degrees C. of 33 $mm^2/s$ and containing cyclohexylamine of 3.35 mass % and stearyl amine 13.7 mass %) also heated at 70 degrees C. were continuously introduced at respective flow rates of 300 mL/min and 180 mL/min into a manufacturing device. An amount of the thickener in the obtained grease was 10 mass % based on the total amount of the grease.

The maximum shear rate (Max) when the mixture passed the gap was 21,000 $s^{-1}$ and minimum shear rate (Min) when the mixture passed the gap was 20,400 $s^{-1}$. The ratio (Max/Min) of the maximum shear rate (Max) to the minimum shear rate (Min) when the mixture passed the gap was 1.03.

Comparative 3

A grease was obtained in the same manner as in Comparative 2 except that an ester synthetic oil (a kinematic viscosity at 40 degrees C. of 33 $mm^2/s$ containing cyclohexyl amine of 2.59 mass % and stearyl amine 10.54 mass %) kept at 60 degrees C. was dropped into an ester synthetic oil (a kinematic viscosity at 40 degrees C. of 33 $mm^2/s$ containing MDI of 7.25 mass %) kept at 60 degrees C. An amount of the thickener in the obtained grease was 10 mass % based on the total amount of the grease.

The maximum shear rate (Max) and minimum shear rate (Min) during manufacturing of each of the greases were respectively 100 $s^{-1}$ and 1.23 $s^{-1}$. The ratio (Max/Min) of the maximum shear rate (Max) to the minimum shear rate (Min) when the mixture passed the gap was 81.

Evaluation of Grease

The grease was evaluated by the above method in terms of worked penetration, centrifugal oil separation degree, Peak High32-64 s, Level High32-64 s and fineness of the lumps. The obtained results are shown in Table 3. The amine composition and amount of the thickener in the amine mixture in each of the greases as well as the maximum shear rate, the minimum shear rate, and the ratio (Max/Min) of the maximum shear rate (Max) to the minimum shear rate (Min) during manufacturing of each of the greases are also shown in Table 3.

TABLE 3

| | Molar Ratio in Amine Mixture (Cy:C18) | Maximum Shear Rate ($s^{-1}$) | Minimum Shear Rate ($s^{-1}$) | Ratio of Maximum Shear Rate to Minimum Shear Rate (Max/Min) (—) | Worked Penetration | Centrifugal Oil Separation Degree (mass %) | Peak High 32-64 s | Level High 32-64 s | Fineness of Lump |
|---|---|---|---|---|---|---|---|---|---|
| Example 7 | Cy:C18 = 4:6 | 21000 | 20400 | 1.03 | 217 | 0.7 | 0.42 | 6.71 | Pass |
| Comparative 2 | Cy:C18 = 4:6 | 100 | 1.23 | 81 | 186 | 0.7 | 3.00 | 11.81 | Failure |
| Example 8 | Cy:C18 = 4:6 | 21000 | 20400 | 1.03 | 244 | 3.4 | 1.04 | 7.55 | Pass |
| Comparative 3 | Cy:C18 = 4:6 | 100 | 1.23 | 81 | 250 | 5.2 | 3.59 | 9.51 | Failure |

According to the results shown in Table 3, a urea grease having an excellent acoustic characteristics was obtained in Examples 7 and 8.

The invention claimed is:

1. A urea grease prepared by shearing a mixture solution comprising an amine mixture comprising an alicyclic monoamine and a chain aliphatic monoamine and a diisocyanate compound to cause a reaction:

wherein:

the urea grease has a Peak High32-64s of 0.7 or less and a Level High32-64s of 7 or less according to an FAG method;

the shearing is carried out at a shear rate of $10^3 s^{-1}$ or more; and the shearing is carried out in a reactor equipped with a rotating portion, an inner wall, a first inlet, and a second inlet, where:

a first base oil comprising the amine mixture is introduced into the reactor via the first inlet, and a second base oil comprising the diisocyanate compound is introduced via the second inlet to obtain the mixture solution; and shear is applied to the mixture solution in the reactor by relative movement of the rotating portion and the inner wall.

2. The urea grease according to claim 1, wherein the mixture solution is sheared at a shear rate of $10^4 s^{-1}$ or more to cause the reaction.

3. The urea grease according to claim 1, wherein the alicyclic monoamine is cyclohexylamine.

4. The urea grease according to claim 1, wherein the chain aliphatic monoamine is stearyl amine.

5. The urea grease according to claim 1, wherein a molar ratio of the alicyclic monoamine to the chain aliphatic monoamine in the amine mixture is in a range from 5:1 to 1:4.

6. The urea grease according to claim 1, wherein the mixture solution is sheared at the shear rate within 15 minutes after mixing the first base oil and the second base oil.

7. The urea grease according to claim 1, wherein the urea grease is heated for 30 minutes or more at a temperature ranging from 70 to 250 degrees C.

8. The urea grease according to claim 1, wherein the shear rate is $10^7 s^{-1}$ or less.

9. The urea grease according to claim 1, wherein a ratio (Max/Min) of a maximum shear rate (Max) to a minimum shear rate (Min) in the shear applied to the mixture solution is 70 or less.

10. The urea grease according to claim 1, wherein the shear rate is $10^4 s^{-1}$ to $10^7 s^{-1}$.

11. The urea grease according to claim 1, wherein a molar ratio of the alicyclic monoamine to the chain aliphatic monoamine is in a range from 4:1 to 2:3.

12. The urea grease according to claim 1, wherein:

the alicyclic monoamine is cyclohexylamine;

the chain aliphatic monoamine is stearyl amine; and a molar ratio of the alicyclic monoamine to the chain aliphatic monoamine in the amine mixture is in a range from 5:1 to 1:4.

13. The urea grease according to claim 1, comprising at least one of an antioxidant, an extreme pressure agent, and a rust inhibitor.

14. The urea grease according to claim 1, comprising 0.05 mass % to 5 mass %, based on a total amount of the grease, of at least one antioxidant selected from the group consisting of an alkylated diphenylamine, phenyl-α-naphthylamine, an alkylated-α-naphthylamine, 2,6-di-t-butyl-4-methylphenol, and 4,4-methylenebis(2,6-di-t-butylphenol).

15. The urea grease according to claim 1, comprising 0.1 mass % to 5 mass %, based on the total amount of the grease, of at least one extreme pressure agent selected from the group consisting of a zinc dialkyldithiophosphate, a molybdenum dialkyldithiophosphate, an ashless dithiocarbamate, a zinc dithiocarbamate, a molybdenum dithiocarbamate, a sulfurized fat or oil, a sulfurized olefin, a polysulfide, a sulfurized mineral oil, a thiophosphate, a thioterpene, a dialkylthiodipropionate, tricresyl phosphate, and triphenyl phosphite.

16. The urea grease according to claim 1, comprising 0.01 mass % to 10 mass %, based on the total amount of the grease, of at least one rust inhibitor selected from the group consisting of zinc stearate, a succinate, a succinic acid derivative, a thiadiazole, benzotriazole, a benzotriazole derivative, sodium nitrite, a petroleum sulfonate, sorbitan monooleate, a fatty acid soap, and an amine compound.

* * * * *